US011052628B2

(12) United States Patent
Shimoda et al.

(10) Patent No.: US 11,052,628 B2
(45) Date of Patent: Jul. 6, 2021

(54) BAG MAKING AND PACKAGING MACHINE

(71) Applicant: ISHIDA CO., LTD., Kyoto (JP)

(72) Inventors: Takafumi Shimoda, Ritto (JP); Makoto Ichikawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 104 days.

(21) Appl. No.: 16/463,846

(22) PCT Filed: Aug. 24, 2017

(86) PCT No.: PCT/JP2017/030311
§ 371 (c)(1),
(2) Date: May 24, 2019

(87) PCT Pub. No.: WO2018/109984
PCT Pub. Date: Jun. 21, 2018

(65) Prior Publication Data

US 2019/0329517 A1 Oct. 31, 2019

(30) Foreign Application Priority Data

Dec. 15, 2016 (JP) ..... JP2016-243561

(51) Int. Cl.
*B31B 70/52* (2017.01)
*B65B 9/207* (2012.01)
*B65B 51/30* (2006.01)

(52) U.S. Cl.
CPC ..... *B31B 70/52* (2017.08); *B65B 9/207* (2013.01); *B65B 51/30* (2013.01)

(58) Field of Classification Search
CPC ..... B31B 70/52; B65B 9/20; B65B 9/207; B65B 9/213; B65B 9/2042; B65B 51/30
(Continued)

(56) References Cited

U.S. PATENT DOCUMENTS 4,915,680 A * 4/1990 Nestle ..... B65H 45/22 493/417
5,246,416 A * 9/1993 Demura ..... B31B 70/00 493/439

(Continued)

FOREIGN PATENT DOCUMENTS

CN 102066200 A * 5/2011 ..... B29C 66/81419
CN 102066200 A 5/2011

(Continued)

OTHER PUBLICATIONS

The Office Action from the corresponding Chinese Patent Application No. 201780074799.0 dated Jun. 29, 2020.

(Continued)

*Primary Examiner* — Thanh K Truong
*Assistant Examiner* — David G Shutty
(74) *Attorney, Agent, or Firm* — Shinjyu Global IP

(57) ABSTRACT

A bag making and packaging machine has pull-down belt mechanisms, a transverse sealing mechanism, a rotatable folding member, and a gas blowing mechanism. The folding member, before the transverse sealing mechanism, seals a cylindrical film, pushes against a side portion of the cylindrical film to thereby fold the cylindrical film inward and form a fold in the cylindrical film. The gas blowing mechanism blows a gas onto the fold to thereby inhibit the cylindrical film from sticking to the rotating folding member.

3 Claims, 11 Drawing Sheets

(58) Field of Classification Search
USPC ..... 53/451, 551
See application file for complete search history.

(56) References Cited

U.S. PATENT DOCUMENTS 6,145,282 A * 11/2000 Tsuruta ..... B29C 66/004 53/551
6,457,297 B1 * 10/2002 Trani ..... B65D 75/30 53/433
6,526,733 B1 * 3/2003 Schellenberg ..... B65B 9/2042 493/11
7,186,025 B2 * 3/2007 Shepard ..... B65B 9/087 383/104
7,213,385 B2 * 5/2007 Knoerzer ..... B65B 9/213 53/412
7,299,608 B2 * 11/2007 Kohl ..... B65B 9/20 53/201
8,776,484 B2 * 7/2014 Kondo ..... B65B 9/2028 53/551
9,127,687 B2 * 9/2015 Fujimoto ..... F04D 17/16
10,239,644 B2 * 3/2019 Michels ..... B29C 66/1122
2003/0236159 A1 * 12/2003 Worthy, Jr. ..... B65D 33/08 493/394
2006/0176763 A1 * 8/2006 Giro Amigo ..... B65B 7/06 366/139
2010/0037567 A1 * 2/2010 Tsuruta ..... B29C 66/1122 53/551
2012/0134795 A1 * 5/2012 Fukuda ..... F04D 29/441 415/206
2013/0028720 A1 * 1/2013 Fujimoto ..... F04D 29/4246 415/203
2016/0290354 A1 * 10/2016 Yagi ..... F04D 29/624

FOREIGN PATENT DOCUMENTS

JP H03-6041 B2 1/1991
JP H06-286709 A 10/1994
JP 3056984 U 3/1999
JP 2003-231189 A 8/2003
JP 2004-522659 7/2004
JP 2006-500287 A 1/2006
JP 2011-006148 A 1/2011
JP 2011006148 A * 1/2011 ..... B65B 9/10

OTHER PUBLICATIONS

The Search Report from the corresponding International Patent Application No. PCT/JP2017/030311 dated Oct. 10, 2017.
The Preliminary Report on Patentability (with Written Opinion) from the corresponding International Patent Application No. PCT/JP2017/030311 dated Jun. 18, 2019.

* cited by examiner

BAG MAKING AND PACKAGING MACHINE

CROSS-REFERENCE TO RELATED APPLICATIONS

This application is the U.S. National Stage of PCT/JP2017/030311, filed Aug. 24, 2017, which claims priority to JP2016-243561, filed Dec. 15, 2016. Both of those applications are incorporated by reference in their entireties.

TECHNICAL FIELD

The present invention relates to a bag making and packaging machine that fills the inside of a packaging material formed into a cylindrical shape with contents and airtightly packages the contents.

BACKGROUND ART

Conventionally, a bag making and packaging machine that fills, with contents such as food, bags formed from a sheet-like packaging material and airtightly packages the contents has been used. The bag making and packaging machine forms the sheet-like packaging material into a cylindrical shape while conveying it downward and seals in the longitudinal direction the overlapping portion of the packaging material that has been formed into a cylindrical shape. Next, the bag making and packaging machine fills the inside of the cylindrical packaging material with the contents and seals the cylindrical packaging material in the transverse direction. Next, the bag making and packaging machine cuts, with a cutter or the like, the portion that has been sealed in the transverse direction to thereby cut away, from the subsequent packaging material, the bag in which the contents have been airtightly packaged.

JP-B No. H3-6041 discloses a bag making and packaging machine that has disc-shaped gusset folding guides installed in such a way as to sandwich from both sides a cylindrical packaging material that has been sealed in the longitudinal direction. The gusset folding guides are members for forming gusseted bags that have folds in their longitudinal direction by rotating while contacting the cylindrical packaging material that is conveyed downward and folding inward both side portions of the cylindrical packaging material. The cylindrical packaging material is filled with the contents and sealed in the transverse direction after the folds have been formed therein by the gusset folding guides. When the cylindrical packaging material in which the folds have been formed is filled with the contents, the angles of the fold lines of the folds increase, and so the cylindrical packaging material bulges. For that reason, the gusseted bags have a large capacity compared to bags that do not have the folds.

BRIEF SUMMARY

In order to form the folds in the longitudinal direction in the cylindrical packaging material, it is necessary to push the gusset folding guides inward in a state in which the gusset folding guides have been brought into contact with the cylindrical packaging material that is conveyed downward. At that time, if the packaging material ends up sticking to the gusset folding guides due to static electricity or the like, there is the concern that the packaging material will get caught on the rotating gusset folding guides and sustain damage.

It is an object of the present invention to provide a bag making and packaging machine that can prevent sticking between a member for folding a cylindrical packaging material inward and the packaging material.

A bag making and packaging machine pertaining to the invention fills a packaging material formed into a cylindrical shape with contents and airtightly packages the contents, and has a conveyance mechanism, a sealing mechanism, a disc-shaped member, and a gas blowing mechanism. The conveyance mechanism conveys the packaging material. The sealing mechanism seals the packaging material that is conveyed by the conveyance mechanism. The disc-shaped member, before the sealing mechanism seals the packaging material, pushes against a side portion of the packaging material to thereby fold the packaging material inward and form a fold in the packaging material. The disc-shaped member is rotatable. The gas blowing mechanism blows a gas onto the fold to thereby inhibit the packaging material from sticking to the rotating disc-shaped member.

This bag making and packaging machine, before filling the inside of the packaging material that has been formed into a cylindrical shape with the contents and sealing the packaging material, folds the cylindrical packaging material inward and forms the fold along the longitudinal direction of the cylindrical packaging material. The fold is formed by pushing the rotating disc-shaped member against the packaging material. When the fold is formed in the packaging material by the disc-shaped member, the gas is blown onto the fold by the gas blowing mechanism. For that reason, a situation where the packaging material sticks to the disc-shaped member due to static electricity or the like, the packaging material gets caught on the rotating disc-shaped member, and the packaging material sustains damage is inhibited. Consequently, this bag making and packaging machine can prevent sticking between the disc-shaped member for folding the cylindrical packaging material inward and the packaging material.

Furthermore, it is preferred that the gas blowing mechanism blow out the gas from an outer peripheral portion of the disc-shaped member toward the packaging material and blow the gas onto the fold.

In this case, the gas is blown out from the outer peripheral portion of the disc-shaped member that contacts the packaging material when the fold is formed in the packaging material, whereby the gas is blown onto the fold. The gas is blown directly onto the fold of the packaging material from the outer peripheral portion of the disc-shaped member, so sticking between the disc-shaped member and the packaging material is effectively inhibited.

Furthermore, it is preferred that the gas blowing mechanism supply the gas to a gas supply space formed between two circular main surfaces of the disc-shaped member, blow out the gas from the gas supply space toward the packaging material, and blow the gas onto the fold.

In this case, the gas that is blown onto the fold of the packaging material is first supplied to the gas supply space formed inside the disc-shaped member. Next, the gas that has been supplied to the gas supply space is blown out from the outer peripheral portion of the disc-shaped member, and the gas is blown onto the fold. The disc-shaped member is rotating, so the gas is blown out evenly from the entire outer peripheral portion of the disc-shaped member. For that reason, the gas blowing mechanism can adjust the amount of the gas that is blown onto the fold by controlling the amount of the gas that is supplied to the gas supply space. That is, the gas blowing mechanism can blow the minimum required amount of the gas onto the fold in order to ensure that the packaging material does not stick to the rotating disc-shaped member. If the amount of the gas that is blown onto the fold of the packaging material is too much, there is the concern that the packaging material will flutter and the packaging material will not be appropriately sealed. Consequently, by adjusting the amount of the gas that is blown onto the fold by the gas blowing mechanism, sticking between the disc-shaped member and the packaging material can be prevented and also fluttering of the packaging material can be inhibited.

Furthermore, it is preferred that the disc-shaped member be configured from two disc parts that oppose each other across a predetermined distance and that the gas blowing mechanism supply the gas to the gas supply space which is formed between the two disc parts.

In this case, the gas blowing mechanism can blow out the gas from the outer peripheral portion of the disc-shaped member toward the fold of the packaging material by supplying the gas to the gas supply space formed between the two disc parts configuring the disc-shaped member. For that reason, using the disc-shaped member that has a simple structure, the gas can be effectively blown out toward the fold of the packaging material.

Furthermore, it is preferred that the gas blowing mechanism blow out the gas at a position away from the disc-shaped member and blow the gas onto the fold.

In this case, the gas blowing mechanism is not connected to the disc-shaped member and blows out the gas toward the fold of the packaging material from a position away from the disc-shaped member. The gas blowing mechanism is independent from the disc-shaped member, so the amount and the angle of the gas that is blown onto the fold of the packaging material can be easily adjusted.

The bag making and packaging machine pertaining to the present invention can prevent sticking between a member for folding a cylindrical packaging material inward and the packaging material.

BRIEF DESCRIPTION OF DRAWINGS

FIG. 5 is a front view of the cylindrical film Fc as seen looking from the front side toward the rear side.

FIG. 6 is a top view of the cylindrical film Fc as seen looking from the upper side toward the lower side.

DETAILED DESCRIPTION

An embodiment of the invention will be described with reference to the drawings. The embodiment described below is a specific example of the invention and is not intended to limit the technical scope of the invention.

(1) Configuration of Bag Making and Packaging Machine

Figure 1:
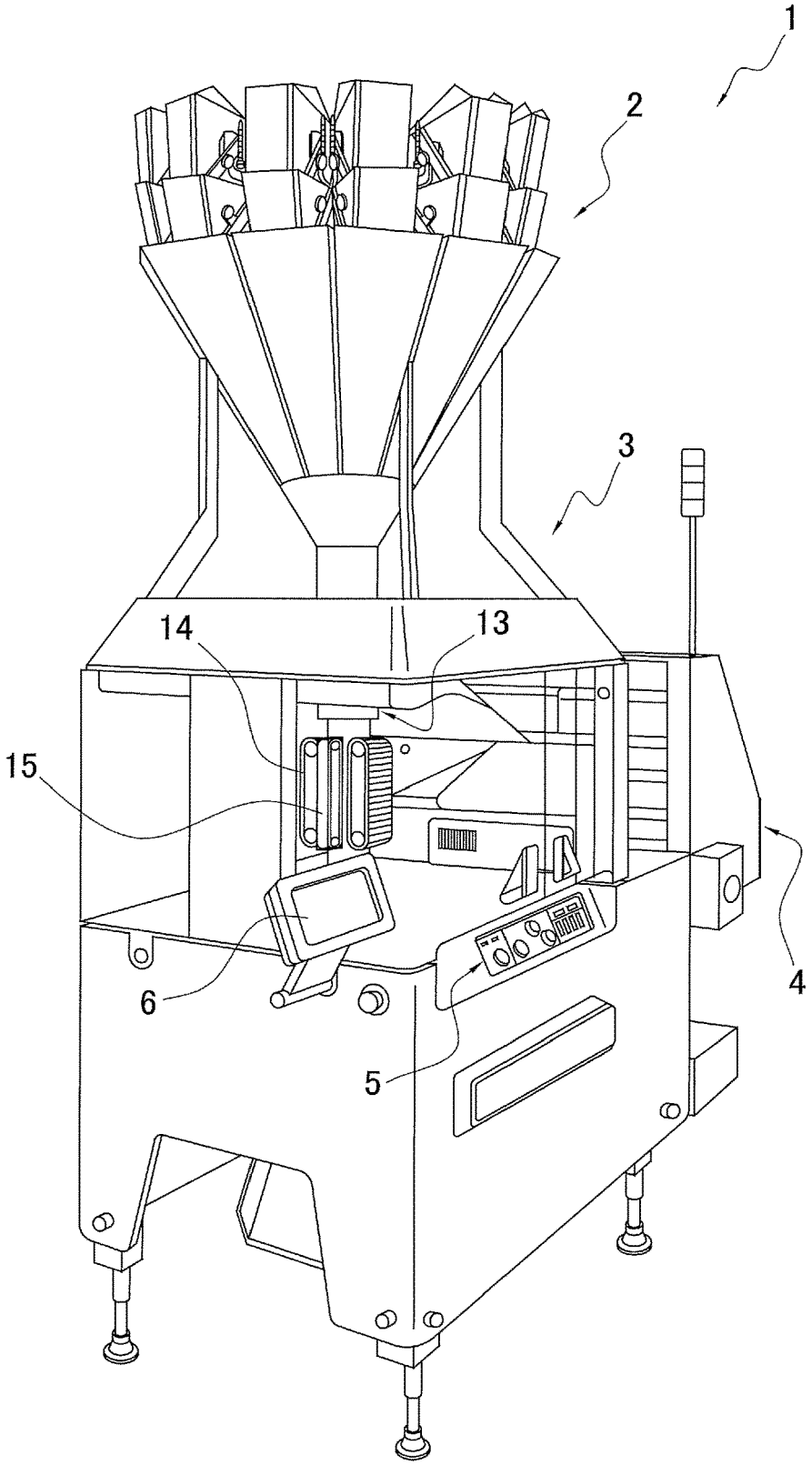
FIG. 1 is a perspective view of a bag making and packaging machine 1 that is an embodiment of the invention.

FIG. 1 is a perspective view of a bag making and packaging machine 1 that is an embodiment of the invention. The bag making and packaging machine 1 is a machine for bagging contents such as food. The bag making and packaging machine 1 is mainly configured from a combination weighing unit 2, a bag making and packaging unit 3, and a film supplying unit 4.

The combination weighing unit 2 is disposed above the bag making and packaging unit 3. The combination weighing unit 2 weighs, with plural weighing hoppers, the weights of the contents and combines the values of the weights that have been weighed by each weighing hopper so as to reach a predetermined total weight. The combination weighing unit 2 discharges downward and supplies to the bag making and packaging unit 3 the contents having the combined predetermined total weight.

The bag making and packaging unit 3 seals in bags and packages the contents in accordance with the timing when the contents are supplied from the combination weighing unit 2. The detailed configuration and operation of the bag making and packaging unit 3 will be described later.

The film supplying unit 4 is installed adjacent to the bag making and packaging unit 3 and supplies to the bag making and packaging unit 3 a film that becomes formed into bags. A film roll wound with the film is set in the film supplying unit 4. The film supplying unit 4 pays out the film from the film roll.

The bag making and packaging machine 1 has operation switches 5 and a liquid crystal display 6. The operation switches 5 and the liquid crystal display 6 are mounted to the front of the bag making and packaging machine 1 body. The liquid crystal display 6 is a touch panel display disposed in a position where the operator of the operation switches 5 can see it. The operation switches 5 and the liquid crystal display 6 function as input devices that receive instructions with respect to the bag making and packaging machine 1 and settings relating to the bag making and packaging machine 1. The liquid crystal display 6 functions as an output device that displays information relating to the bag making and packaging machine 1.

The bag making and packaging machine 1 has a control unit (not shown in the drawings). The control unit is a computer configured from a CPU, a ROM, and a RAM, for example. The control unit is connected to the combination weighing unit 2, the bag making and packaging unit 3, the film supplying unit 4, the operation switches 5, and the liquid crystal display 6. The control unit controls the combination weighing unit 2, the bag making and packaging unit 3, and the film supplying unit 4 on the basis of input from the operation switches 5 and the liquid crystal display 6 and outputs various types of information to the liquid crystal display 6.

(2) Configuration of Bag Making and Packaging Unit

Figure 2:
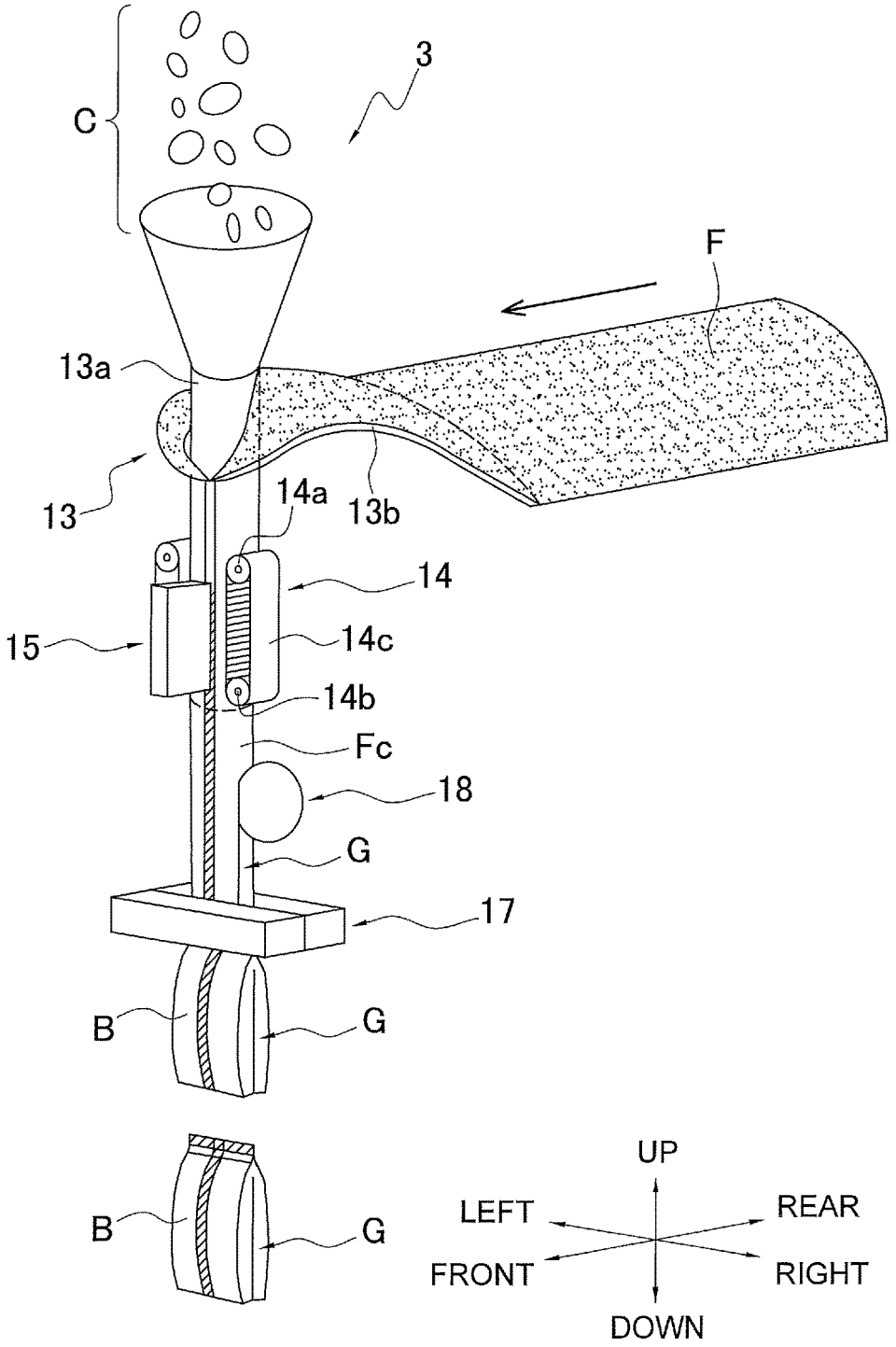
FIG. 2 is a perspective view showing the schematic configuration of a bag making and packaging unit 3.

FIG. 2 is a perspective view showing the schematic configuration of the bag making and packaging unit 3. In the following description, the six directions of "front (front surface)," "rear (back surface)," "up," "down," "left," and "right" are defined as shown in FIG. 2.

The bag making and packaging unit 3 is mainly configured from a forming mechanism 13, pull-down belt mechanisms 14, a longitudinal sealing mechanism 15, a transverse sealing mechanism 17, a gusset forming mechanism 18, and a gas blowing mechanism 19. The forming mechanism 13 forms into a cylindrical shape the sheet-like film F that is supplied from the film supplying unit 4. The pull-down belt mechanisms 14 convey downward the film F that has been formed into a cylindrical shape. The longitudinal sealing mechanism 15 seals, in the longitudinal direction parallel to the conveyance direction, the overlapping portion of both end portions of the film F that has been formed into a cylindrical shape to thereby form a cylindrical film Fc. The transverse sealing mechanism 17 seals the cylindrical film Fc in the transverse direction orthogonal to the conveyance direction to thereby form bags B whose upper end portions and lower end portions have been sealed. The gusset forming mechanism 18 forms a fold G along the conveyance direction in the cylindrical film Fc before the cylindrical film Fc is sealed by the transverse sealing mechanism 17. The gas blowing mechanism 19 is a mechanism for blowing a gas onto the fold G that has been formed in the cylindrical film Fc. In FIG. 2, the portions that have been sealed by the longitudinal sealing mechanism 15 and the transverse sealing mechanism 17 are indicated as hatched regions.

(2-1) Forming Mechanism

The forming mechanism 13 has a tube 13*a* and a former 13*b*. The tube 13*b* is an open cylinder-shaped member whose upper end and lower end are open. The contents C supplied from the combination weighing unit 2 are input to the opening in the upper end of the tube 13*a*. The former 13*b* is disposed surrounding the tube 13*a*. The film F that has been paid out from the film roll of the film supplying unit 4 wraps around the tube 13*a* and is formed into a cylindrical shape when it passes through a gap between the tube 13*a* and the former 13*b*. The tube 13*a* and the former 13*b* can be replaced in accordance with the size of the bags B that are to be manufactured.

(2-2) Pull-down Belt Mechanisms

The pull-down belt mechanisms 14 suck and convey downward the film F wrapped around the tube 13*a*. The pull-down belt mechanisms 14 mainly have drive rollers 14*a*, follower rollers 14*b*, and a pair of belts 14*c*. The pair of belts 14*c* are disposed on both the right and left sides of the tube 13*a* so as to sandwich the tube 13*a* as shown in FIG. 2 and have mechanisms that suck the film F that has been formed into a cylindrical shape. The pair of belts 14*c* are driven to rotate by the drive rollers 14*a* and the follower rollers 14*b*, whereby the pull-down belt mechanisms 14 convey downward the film F that has been formed into a cylindrical shape. That is, the conveyance direction of the film F is a direction heading from the upper side to the lower side in FIG. 2.

(2-3) Longitudinal Sealing Mechanism

The longitudinal sealing mechanism 15 seals in the longitudinal direction (the up and down direction in FIG. 2) the film F that has been formed into a cylindrical shape. The longitudinal sealing mechanism 15 is disposed on the front side of the tube 13*a*. The longitudinal sealing mechanism 15 is moved by a drive mechanism (not shown in the drawings) in forward and rearward directions toward the tube 13*a* or away from the tube 13*a*.

When the longitudinal sealing mechanism 15 is driven by the drive mechanism toward the tube 13*a*, the overlapping portion in the longitudinal direction of the film F wrapped around the tube 13*a* becomes sandwiched between the longitudinal sealing mechanism 15 and the tube 13*a*. Because of the drive mechanism, the longitudinal sealing mechanism 15 pushes the overlapping portion of the film F with a fixed pressure against the tube 13*a* and heats it to thereby heat-seal the overlapping portion of the film F in the longitudinal direction and form the cylindrical film Fc. The longitudinal sealing mechanism 15 has a heater that heats the overlapping portion of the film F and a heater belt that contacts the overlapping portion of the film F.

(2-4) Transverse Sealing Mechanism

The transverse sealing mechanism 17 seals the cylindrical film Fc in the transverse direction (the right and left direction in FIG. 2). The transverse sealing mechanism 17 is disposed under the forming mechanism 13, the pull-down belt mechanisms 14, the longitudinal sealing mechanism 15, and the gusset forming mechanism 18.

Figure 3:
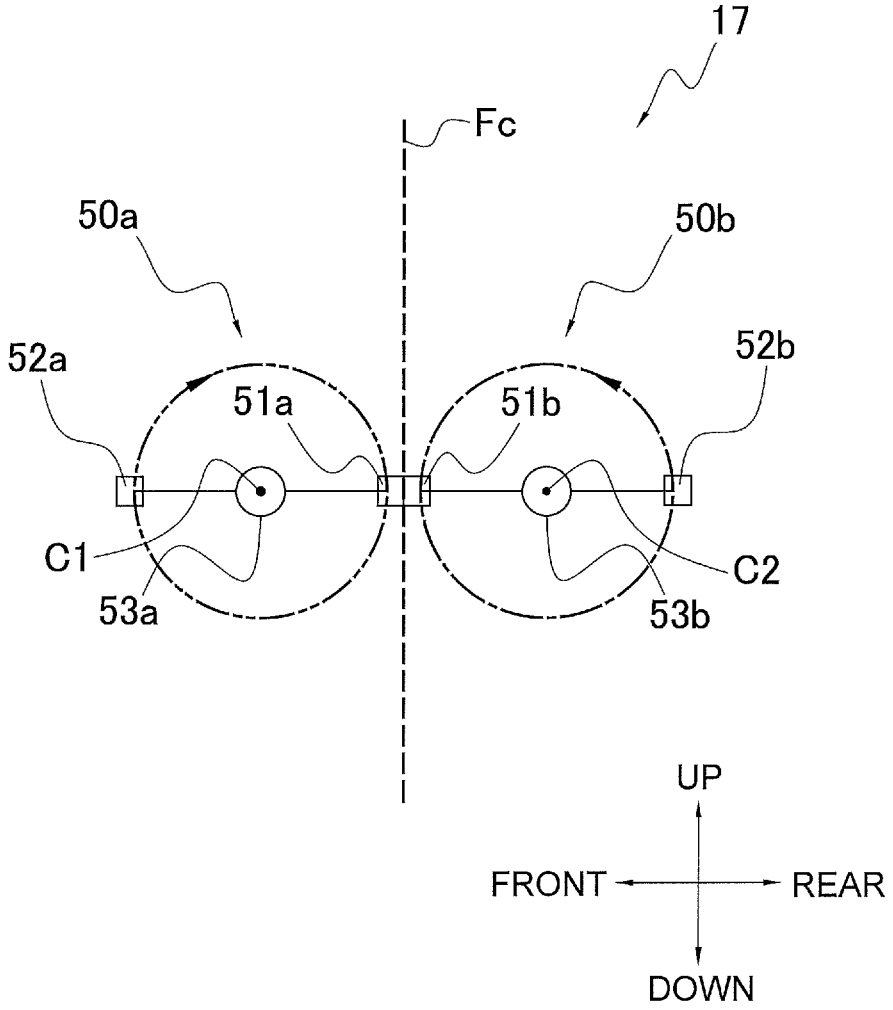
FIG. 3 is a schematic side view of a transverse sealing mechanism 17 as seen from the right side of FIG. 2.

FIG. 3 is a schematic side view of the transverse sealing mechanism 17 as seen from the right side of FIG. 2. In FIG. 3, the direction perpendicular to the page is the right and left direction in FIG. 2. The transverse sealing mechanism 17 mainly has a first rotating body 50*a* and a second rotating body 50*b*. The first rotating body 50*a* is disposed on the front side of the cylindrical film Fc. The second rotating body 50*b* is disposed on the rear side of the cylindrical film Fc. Within the page of FIG. 3, the first rotating body 50*a* is positioned on the left side of the cylindrical film Fc, and the second rotating body 50*b* is positioned on the right side of the cylindrical film Fc.

The first rotating body 50*a* mainly has a first rotating shaft 53*a*, a first sealing jaw 51*a*, and a second sealing jaw 52*a*. The second rotating body 50*b* mainly has a second rotating shaft 53*b*, a first sealing jaw 51*b*, and a second sealing jaw 52*b*. The first rotating body 50*a*, when seen along the right and left direction, rotates about a rotational center C1 of the first rotating shaft 53*a* using the first rotating shaft 53*a* as a rotational axis. The second rotating body 50*b*, when seen along the right and left direction, rotates about a rotational center C2 of the second rotating shaft 53*b* using the second rotating shaft 53*b* as a rotational axis. When the transverse sealing mechanism 17 is seen along the right and left direction, the pair of first sealing jaws 51*a*, 51*b* synchronously rotate in mutually opposite directions, and the pair of second sealing jaws 52*a*, 52*b* synchronously rotate in mutually opposite directions. In FIG. 3, the paths traced by the pair of first sealing jaws 51*a*, 51*b* and the pair of second sealing jaws 52*a*, 52*b* are indicated by long-dashed short-dashed lines.

The transverse sealing mechanism 17 sandwiches, with the pair of first sealing jaws 51*a*, 51*b* or the pair of second sealing jaws 52*a*, 52*b* and along the transverse direction (the right and left direction in FIG. 2) intersecting the conveyance direction of the cylindrical film Fc, the cylindrical film Fc that is conveyed downward. The pair of first sealing jaws 51*a*, 51*b* or the pair of second sealing jaws 52*a*, 52*b* heat-seal the cylindrical film Fc in the transverse direction by sandwiching and heating the cylindrical film Fc.

The cylindrical film Fc that has been sealed in the transverse direction by the transverse sealing mechanism 17 is cut away from the subsequent cylindrical film Fc as a result of the portion that has been sealed in the transverse direction being cut in the transverse direction by a cutter (not shown in the drawings). As shown in FIG. 2, the portion that has been cut away from the cylindrical film Fc becomes a bag B made airtight by its upper side and lower side being sealed in the transverse direction.

(2-5) Gusset Forming Mechanism 18

The gusset forming mechanism 18 is disposed under the longitudinal sealing mechanism 15 and above the transverse sealing mechanism 17. The gusset forming mechanism 18 forms a fold G called a gusset along the longitudinal direction (the up and down direction in FIG. 2) in the cylindrical film Fc before the cylindrical film Fc is sealed by the transverse sealing mechanism 17. The fold G is a portion folded toward the inside of the cylindrical film Fc. As shown in FIG. 2, the fold G is formed in the side portion of the bag B in such a way as to be folded toward the interior of the bag. The fold G is formed in order to increase the capacity of the bags B and to allow the bags B to stand up on their own.

Figure 4:
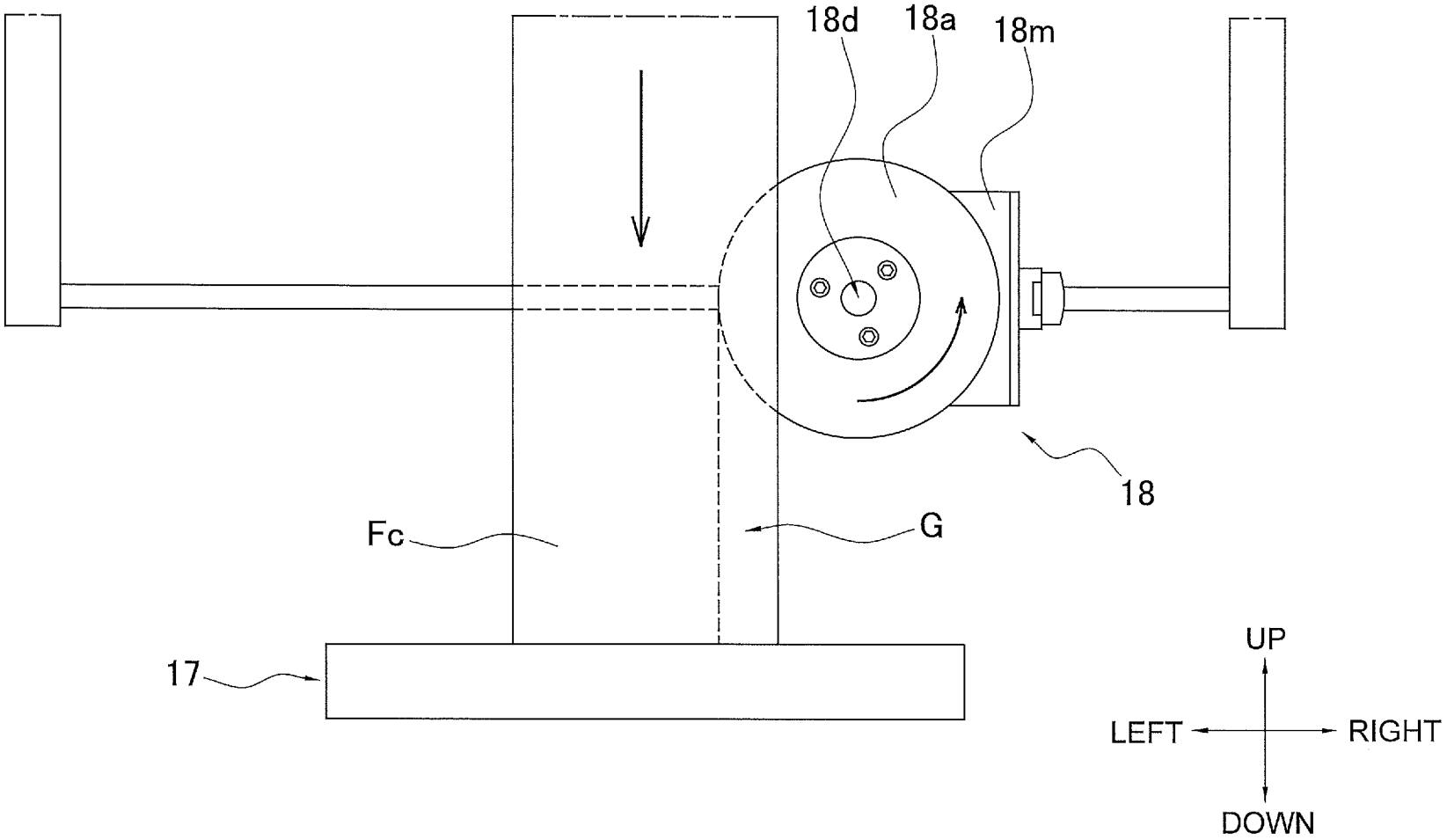
FIG. 4 is a view showing the configuration of a gusset forming mechanism 18.

FIG. 4 is a view showing the configuration of the gusset forming mechanism 18. FIG. 4 is a view looking from the front side toward the rear side of FIG. 2. Shown in FIG. 4 are the cylindrical film Fc that is conveyed downward and the transverse sealing mechanism 17. The gusset forming mechanism 18 is secured to a frame or the like of the bag making and packaging unit 3.

The gusset forming mechanism 18 mainly has one folding member 18*a* and a servo motor 18*m*. The folding member 18*a* is a disc-shaped member that is rotatable about a rotating shaft 18*d*. The servo motor 18*m* has a mechanism that causes the folding member 18*a* to move in the right and left direction and a mechanism that causes the folding member 18*a* to rotate about the rotating shaft 18*d*. The rotating shaft 18*d* is a shaft that passes through the centers of two circular main surfaces of the folding member 18*a*. In FIG. 4, the conveyance direction of the cylindrical film Fc and the rotational direction of the folding member 18*a* are indicated by arrows. The servo motor 18*m* controls the operation of the folding member 18*a* in such a way that the rotational speed of the folding member 18*a* is a little faster than the conveyance speed of the cylindrical film Fc.

As shown in FIG. 4, the folding member 18*a* is positioned on the right side of the cylindrical film Fc when the bag making and packaging unit 3 is seen from the front. The folding member 18*a* rotates in the same direction as the conveyance direction of the cylindrical film Fc on the side where the cylindrical film Fc is conveyed. That is, in FIG. 4, the folding member 18*a* rotates counter-clockwise. The folding member 18*a* is disposed in such a way that the rotating shaft 18*d* lies along the front and rear direction. That is, the disc-shaped circular main surfaces of the folding member 18*a* are surfaces orthogonal to the front and rear direction.

Figure 5:
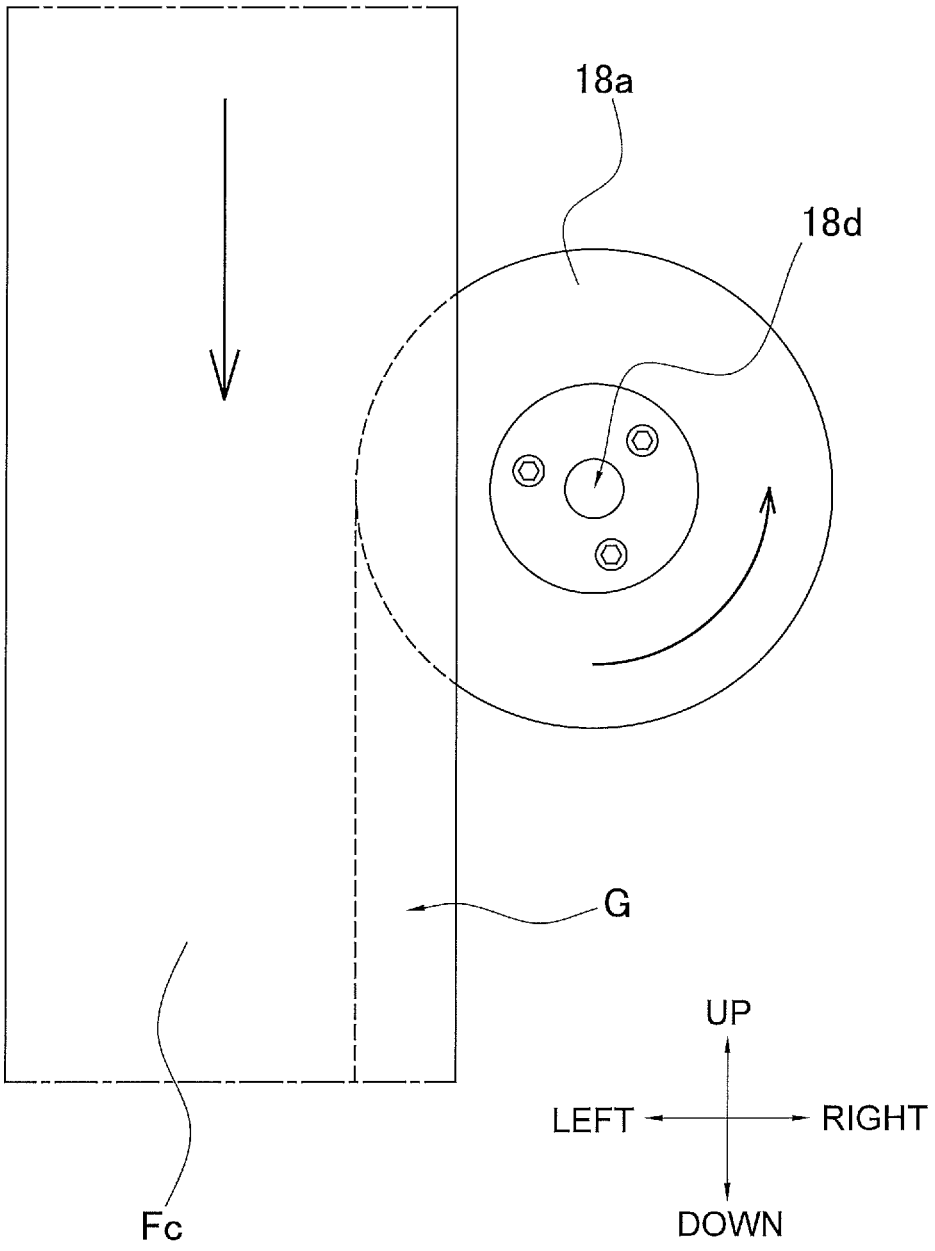
FIG. 5 is a view showing a state in which a folding member 18*a* is pushing against a cylindrical film Fc.
Figure 6:
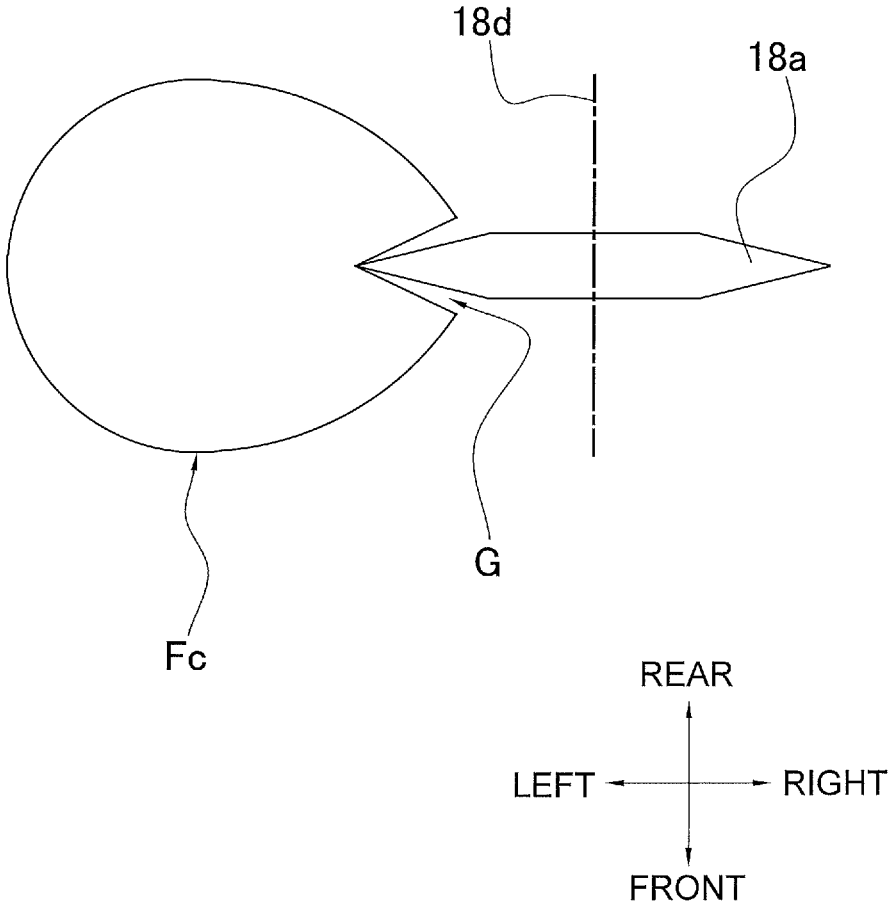
FIG. 6 is a view showing a state in which the folding member 18*a* is pushing against the cylindrical film Fc.

The folding member 18*a* is a member for forming the fold G in the cylindrical film Fc by rotating about the rotating shaft 18*d* and pushing against the side portion of the cylindrical film Fc that is conveyed downward. FIG. 5 and FIG. 6 are views showing a state in which the folding member 18*a* is pushing against the cylindrical film Fc. FIG. 5 is a front view of the cylindrical film Fc as seen looking from the front side toward the rear side. FIG. 6 is a top view of the cylindrical film Fc as seen looking from the upper side toward the lower side at the height position at which the cylindrical film Fc and the folding member 18*a* contact each other. The gusset forming mechanism 18 uses the servo motor 18*m* to cause the folding member 18*a* to move in such a way that the left-side end portion of the folding member 18*a* is positioned on the left side of the right-side end portion of the cylindrical film Fc (the inside of the cylindrical film Fc). Because of this, as shown in FIG. 5 and FIG. 6, the rotating disc-shaped folding member 18*a* pushes against the right side portion of the cylindrical film Fc. When the cylindrical film Fc receives force from the folding member 18*a*, the fold G that extends in the up and down direction is formed in the right side portion of the cylindrical film Fc.

Figure 7:
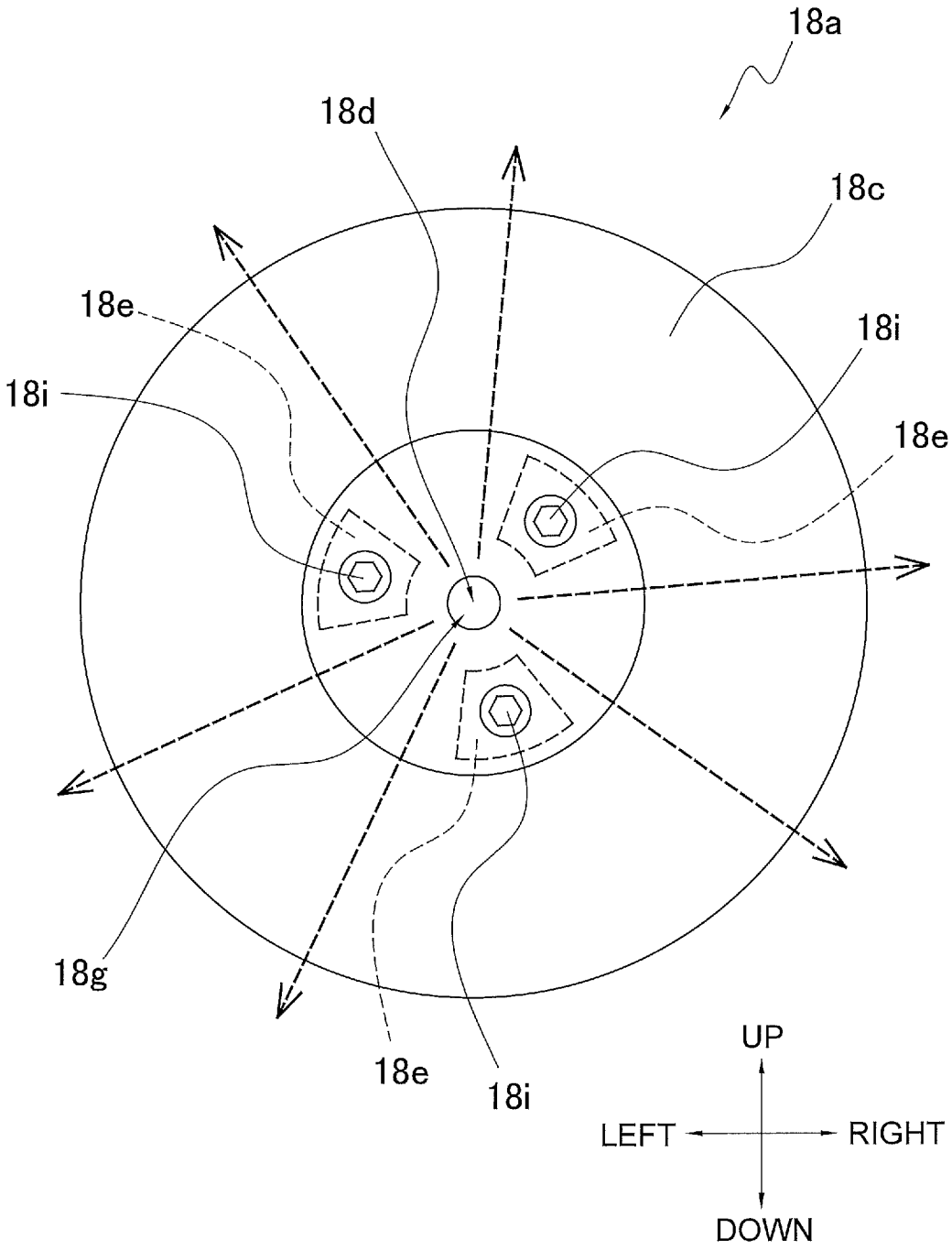
FIG. 7 is a view of the folding member 18*a* as seen along a rotating shaft 18*d*.
Figure 8:
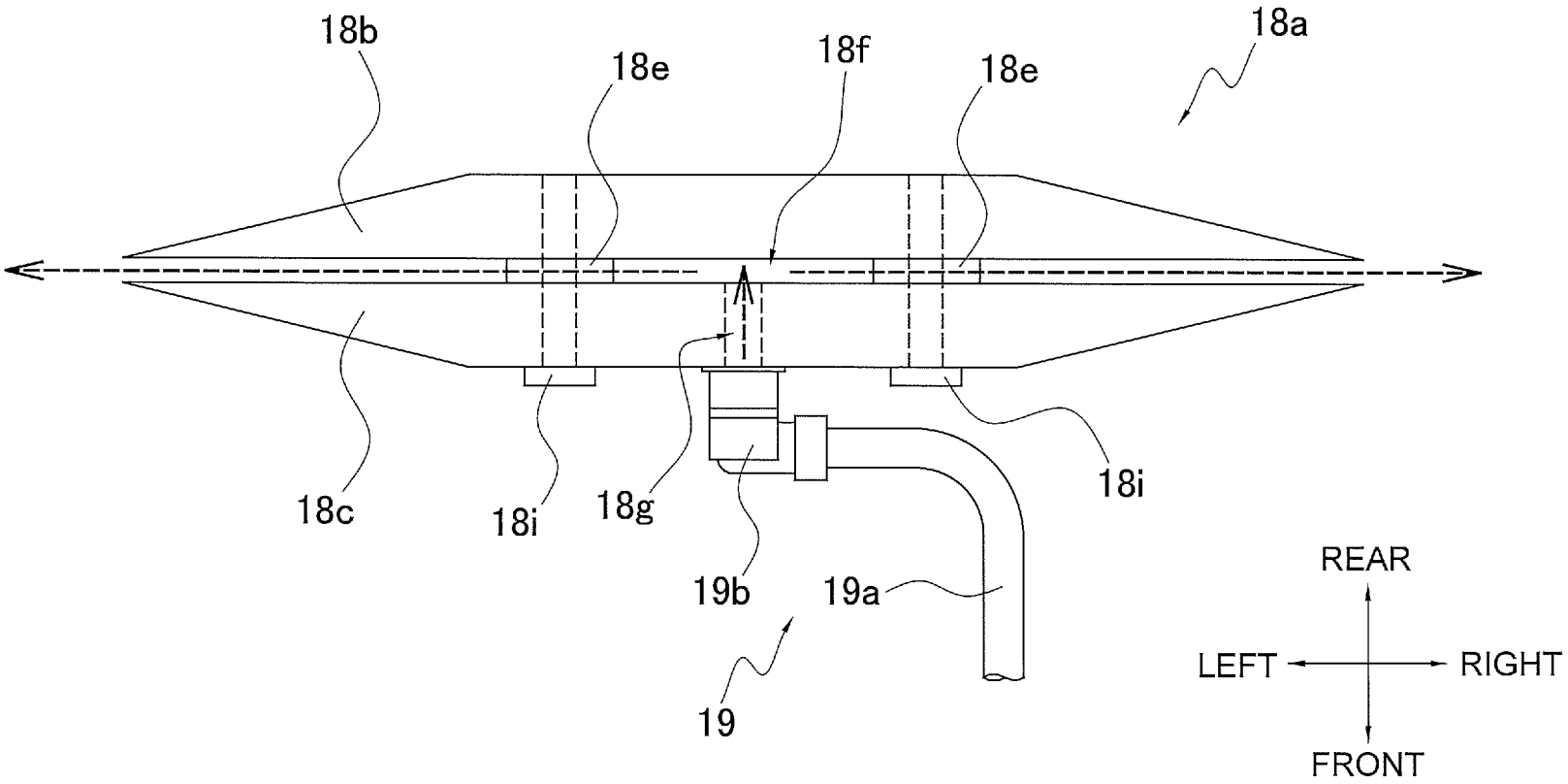
FIG. 8 is a view of the folding member 18*a* as seen along a direction orthogonal to the rotating shaft 18*d*.

FIG. 7 and FIG. 8 are views showing the detailed configuration of the folding member 18*a*. FIG. 7 is a view of the folding member 18*a* as seen along the rotating shaft 18*d*. FIG. 8 is a view of the folding member 18*a* as seen along a direction orthogonal to the rotating shaft 18*d*.

As shown in FIG. 7 and FIG. 8, the folding member 18*a* is mainly configured from two disc parts 18*b*, 18*c* and three spacers 18*e*. The two disc parts 18*b*, 18*c* have the same dimensions when seen along the rotating shaft 18*d*. The disc parts 18*b*, 18*c* and the spacers 18*e* are made of resin, for example. The two disc parts 18*b*, 18*c* sandwich the spacers 18*e* between them and are thereby secured in a state in which they are spaced a predetermined distance apart from each other. As shown in FIG. 7, the two disc parts 18*b*, 18*c* and each spacer 18*e* are secured to each other by a bolt 18*i*. The bolt 18*i* is a member for passing through the two disc parts 18*b*, 18*c* and one spacer 18*e* and securing these to each other. That is, the folding member 18*a* is a member in which the two disc parts 18*b*, 18*c* and the three spacers 18*e* are secured to each other by three bolts 18*i*. It will be noted that in FIG. 8 the distance between the two disc parts 18*b*, 18*c* is shown more exaggerated than it really is in order to make it easier to understand the structure of the folding member 18*a*.

As shown in FIG. 7, the spacers 18*e* are disposed equidistantly around the rotating shaft 18*d* in the center portion of the two disc parts 18*b*, 18*c*. That is, the three spacers 18*e* are away from each other. For that reason, the space between the two disc parts 18*b*, 18*c* is not partitioned by the three spacers 18*e*. Hereinafter, the space between the two disc parts 18*b*, 18*c* will be called a gas supply space 18*f*.

The two disc parts 18*b*, 18*c* are configured from a first disc part 18*b* positioned in back and a second disc part 18*c* positioned in front. The first disc part 18*b* is connected to the servo motor 18*m* via a shaft (not shown in the drawings). The servo motor 18*m* causes the shaft to axially rotate to thereby cause the folding member 18*a* to rotate about the rotating shaft 18*d*. The second disc part 18*c* is connected to the gas blowing mechanism 19 described later.

In the folding member 18*a* shown in FIG. 7 and FIG. 8, the main surfaces of the disc parts 18*b*, 18*c* that are in contact with the spacers 18*e* have flat circular shapes. As shown in FIG. 8, the thicknesses of the disc parts 18*b*, 18*c* gradually become larger heading from the outer peripheral portion to the center portion and then become fixed. That is, as shown in FIG. 6, the folding member 18*a* has a tapered outer peripheral portion. Furthermore, as shown in FIG. 7, the spacers 18*e* are in contact with the disc parts 18*b*, 18*c* where the thicknesses of the disc parts 18*b*, 18*c* are at their largest. However, the shapes and the positional relationships of the two disc parts 18*b*, 18*c* and the three spacers 18*e* are not limited to those shown in FIG. 7 and FIG. 8.

(2-6) Gas Blowing Mechanism 19

The gas blowing mechanism 19 is a device that has a tube 19*a* that delivers a gas such as air and a nozzle 19*b* that blows out the gas that has been delivered thereto by the tube 19*a*. As shown in FIG. 8, the nozzle 19*b* of the gas blowing mechanism 19 is connected to a gas supply hole 18*g* formed in the center portion of the second disc part 18*c* of the folding member 18*a*. In FIG. 7, the gas blowing mechanism 19 is not shown. The gas supply hole 18*g* communicates with the gas supply space 18*f*.

The gas blowing mechanism 19 uses the tube 19*a* and the nozzle 19*b* to blow out the gas in the gas supply hole 18*g* in the folding member 18*a* and supply the gas to the gas supply space 18*f* of the folding member 18*a*. In FIG. 7 and FIG. 8, the flow of the gas in the gas supply space 18*f* is indicated by dashed arrows. The gas that has been supplied to the gas supply space 18*f* flows from the center portion of the disc parts 18*b*, 18*c*, in between the spacers 18*e*, and toward the outer peripheral portion. Thereafter, the gas flowing through the gas supply space 18*f* is blown out from the outer peripheral portion of the folding member 18*a*. Members such as the spacers 18*e* are not provided in the outer peripheral portion of the folding member 18*a*. For that reason, the gas that has been blown out from the gas blowing mechanism 19 flows through the gas supply space 18*f* and thereafter is blown out evenly from the entire outer peripheral portion of the folding member 18*a*. The gas blowing mechanism 19 has a mechanism for adjusting the amount of the gas that is to be blown out from the nozzle 19*b*.

(3) Operation of Bag Making and Packaging Machine

First, an overview of the operation by which the bag making and packaging machine 1 seals the contents C in the bags B will be described. The film F that has been supplied from the film supplying unit 4 to the bag making and packaging unit 3 is wrapped around the tube 13*a* and formed into a cylindrical shape, and is conveyed downward by the pull-down belt mechanisms 14. Both end portions—extending in the up and down direction—of the cylindrical film F wrapped around the tube 13*a* are overlapped on top of each other. The overlapping portion of the film F that has been formed into a cylindrical shape is sealed in the longitudinal direction by the longitudinal sealing mechanism 15, whereby the cylindrical film Fc is formed.

The cylindrical film Fc that has been longitudinally sealed comes off from the tube 13*a* and thereafter has the fold G formed therein by the folding member 18*a* of the gusset forming mechanism 18. The fold G is formed along the up and down direction in the side surface on the right side of the cylindrical film Fc. The cylindrical film Fc in which the fold G has been formed is conveyed downward to the position of the transverse sealing mechanism 17. The transverse sealing mechanism 17 uses the pair of first sealing jaws 51*a*, 51*b* or the pair of second sealing jaws 52*a*, 52*b* to sandwich the cylindrical film Fc and seal it in the transverse direction. At this time, under the portion of the cylindrical film Fc that has been sealed in the transverse direction, the bag B in which the contents C have been enclosed is formed. At the same time, above the portion of the cylindrical film Fc that has been sealed in the transverse direction, the contents C that have been weighed by the combination weighing unit 2 drop through the inside of the tube 13*a* and are input to the cylindrical film Fc.

Furthermore, in accordance with the timing when the cylindrical film Fc is sealed in the transverse direction, the portion of the cylindrical film Fc that has been sealed in the transverse direction is cut in the transverse direction by the cutter (not shown in the drawings) built into the first sealing jaw 51*a* or the second sealing jaw 52*a*. Because of this, the bag B in which the contents C are enclosed is cut away from the subsequent cylindrical film Fc. The fold G is formed in the side surface on the right side of the bag B.

In the way described above, the bags B in which the contents C are enclosed are continuously manufactured. The manufactured bags B are thereafter transferred by a belt conveyor (not shown in the drawings) or the like to devices such as a thickness checker and a weight checker.

(4) Characteristics

The bag making and packaging machine 1 forms, with the gusset forming mechanism 18, the fold G in the cylindrical film Fc before sealing, with the transverse sealing mechanism 17, the cylindrical film Fc that has been formed by the forming mechanism 13. Specifically, the gusset forming mechanism 18 causes the folding member 18*a* to rotate and at the same time pushes the folding member 18*a* against the side portion of the cylindrical film Fc that is conveyed downward. Because of this, as shown in FIG. 5 and FIG. 6, the cylindrical film Fc is folded toward the inside of the cylindrical film Fc by the force it receives from the folding member 18*a*, whereby the fold G along the conveyance direction of the cylindrical film Fc is formed. The cylindrical film Fc in which the fold G has been formed is filled with the contents C and thereafter is sealed by the transverse sealing mechanism 17. Because of this series of processes, the bag making and packaging machine 1 can manufacture the bags B in which the single fold G is formed.

In the bag making and packaging machine 1, when the fold G is formed in the cylindrical film Fc by the folding member 18*a*, the gas that has been supplied from the gas blowing mechanism 19 is blown out from the outer peripheral portion of the rotating folding member 18*a*. The rotating folding member 18*a* is pushed against the cylindrical film Fc, so the gas that has been blown out from the outer peripheral portion of the folding member 18*a* is blown onto the fold G of the cylindrical film Fc. For that reason, even if a force by which the cylindrical film Fc sticks to the folding member 18*a* acts due to static electricity or the like, a force by which the cylindrical film Fc tends to separate from the folding member 18*a* acts because of the gas blowing out from the outer peripheral portion of the folding member 18*a*. Because of this, a situation where the cylindrical film Fc sticks to and gets caught on the rotating folding member 18*a* so that the cylindrical film Fc tears and sustains damage is inhibited. Consequently, the bag making and packaging machine 1 can prevent sticking between the disc-shaped folding member 18*a* for folding the cylindrical film Fc inward and the cylindrical film Fc.

Furthermore, in the bag making and packaging machine 1, the gas that has been supplied from the gas blowing mechanism 19 is blown out from the outer peripheral portion of the folding member 18*a* and is blown onto the fold G of the cylindrical film Fc. For that reason, the gas is blown directly onto the side portion of the cylindrical film Fc that contacts the rotating folding member 18*a*. For that reason, sticking between the folding member 18*a* and the cylindrical film Fc is effectively inhibited.

Furthermore, in the bag making and packaging machine 1, the folding member 18*a* is configured from the two disc parts 18*b*, 18*c* that oppose each other across a predetermined distance, and the gas blowing mechanism 19 supplies the gas to the gas supply space 18*f* formed between the two disc parts 18*b*, 18*c*. The two disc parts 18*b*, 18*c* are spaced apart from each other by the three spacers 18*e* installed in the center portion. For that reason, the two disc parts 18*b*, 18*c* are not in contact with each other at the outer peripheral portion. Consequently, the gas blowing mechanism 19 can blow out the gas from the entire outer peripheral portion of the folding member 18*a* by supplying the gas to the gas supply space 18*f*.

Furthermore, in the bag making and packaging machine 1, the gas blowing mechanism 19 is a mechanism for supplying the gas to the gas supply space 18*f* formed between the two disc parts 18*b*, 18*c* of the folding member 18*a*, blowing out from the outer peripheral portion of the folding member 18*a* the gas that has been supplied to the gas supply space 18*f*, and blowing the gas onto the fold G of the cylindrical film Fc. The gas that has been supplied to the gas supply space 18*f* is blown out from the outer peripheral portion of the folding member 18*a* while the folding member 18*a* rotates about the rotating shaft 18*d*. Furthermore, the spacers 18*e* sandwiched between the two disc parts 18*b*, 18*c* of the folding member 18*a* are installed in the center portion of the disc parts 18*b*, 18*c*. For that reason, as shown in FIG. 7, the gas in the gas supply space 18*f* is blown out evenly from the entire outer peripheral portion of the rotating folding member 18*a*. Because of this, the gas blowing mechanism 19 can adjust the amount of the gas that is blown onto the fold G by controlling the amount of the gas that is supplied to the gas supply space 18*f*. That is, the gas blowing mechanism 19 can blow the minimum required amount of the gas onto the fold G in order to ensure that the cylindrical film Fc does not stick to and get caught on the rotating folding member 18*a*. If the amount of the gas that is blown onto the fold G is too much, there is the concern that the cylindrical film Fc will flutter because of the gas and the cylindrical film Fc will not be appropriately sealed by the transverse sealing mechanism 17. Consequently, by adjusting the amount of the gas that is blown onto the fold G by the gas blowing mechanism 19, sticking between the folding member 18*a* and the cylindrical film Fc is prevented and also fluttering of the cylindrical film Fc is inhibited, so the cylindrical film Fc can be appropriately sealed by the transverse sealing mechanism 17.

Furthermore, in the bag making and packaging machine 1, the gusset forming mechanism 18 can move, using the servo motor 18*m*, the folding member 18*a* in the right and left direction but cannot move it in the up and down direction. That is, the up and down direction position of the folding member 18*a* is fixed. For that reason, it is not necessary to ensure a large space between the longitudinal sealing mechanism 15 and the transverse sealing mechanism 17 in order to install the gusset forming mechanism 18 under the longitudinal sealing mechanism 15 and above the transverse sealing mechanism 17. That is, the distance between the position at which the fold G is formed in the cylindrical film Fc by the gusset forming mechanism 18 and the position at which the cylindrical film Fc is sealed by the transverse sealing mechanism 17 can be reduced. The shorter this distance is, the more the amount of time from when the fold G is formed in the cylindrical film Fc to when the cylindrical film Fc is sealed in the transverse direction can be shortened, so the aesthetic look of the bags B is inhibited from being decreased by opening of the fold G that has been formed by the gusset forming mechanism 18. That is, the bag making and packaging machine 1 can enhance, with the gusset forming mechanism 18 that has the folding member 18*a*, the aesthetic look of the bags B after they have been sealed by the transverse sealing mechanism 17.

Furthermore, in the bag making and packaging machine 1, the gusset forming mechanism 18 blows out the gas from the entire outer peripheral portion of the rotating folding member 18*a*. For that reason, the gas that has been blown out from the lower end portion of the folding member 18*a* is blown also onto the fold G just after the fold G has been formed in the cylindrical film Fc by the folding member 18*a*. Because of this, the fold G just after it has been formed is inhibited from opening, so the aesthetic look of the bags B after they have been sealed by the transverse sealing mechanism 17 is inhibited from being decreased.

(5) Example Modifications

An embodiment of the invention has been described above, but the invention is not limited to the above embodiment and can be changed in a variety of ways in a range that does not depart from the spirit of the invention.

(5-1) Example Modification A

In the embodiment, the gusset forming mechanism 18 has only one folding member 18*a* for forming the fold G in the right side portion of the cylindrical film Fc. However, the gusset forming mechanism 18 may also have two folding members 18*a* for forming the fold G in the left side portion and the right side portion of the cylindrical film Fc.

Figure 9:
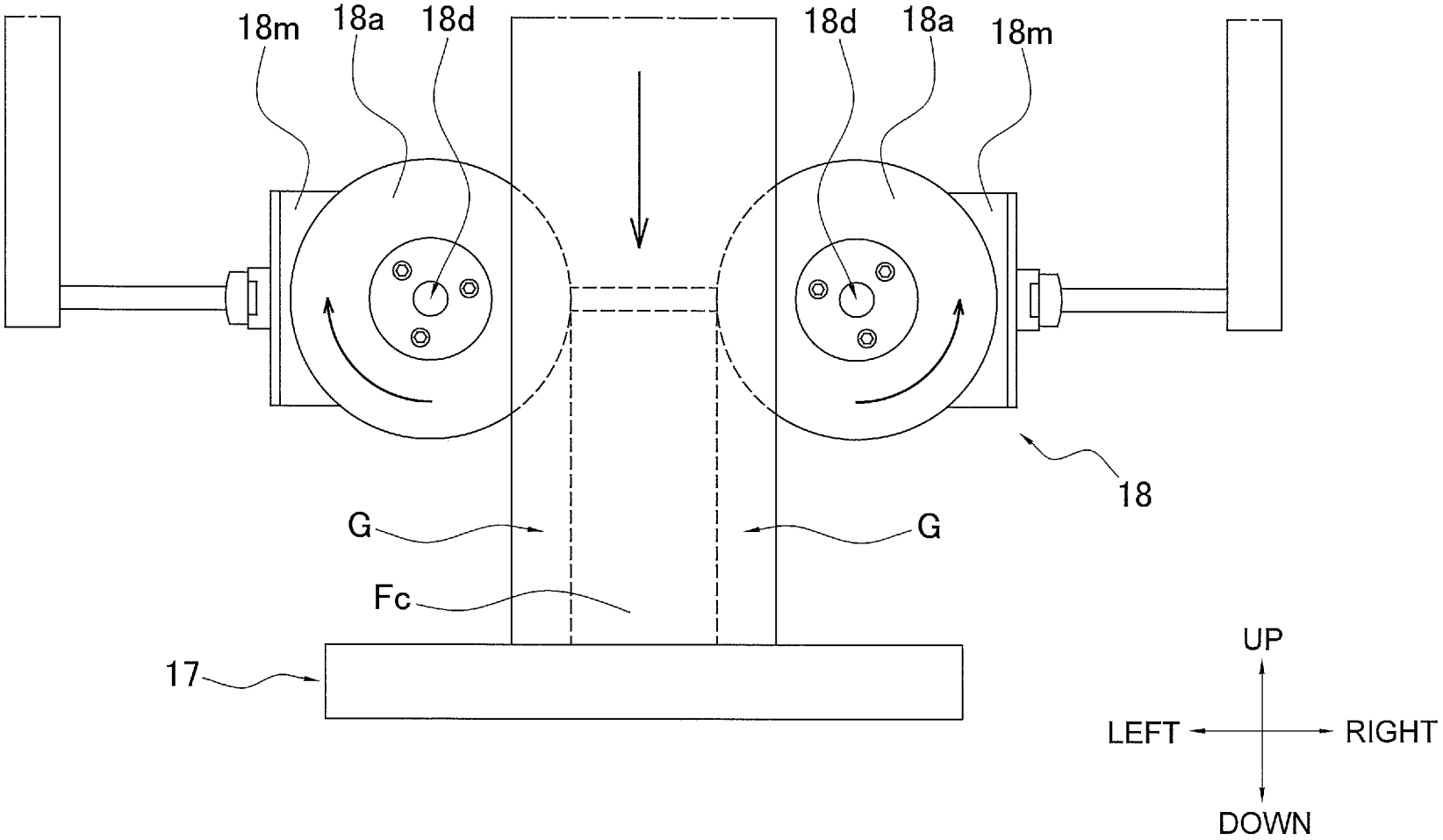
FIG. 9 is a view showing the configuration of the gusset forming mechanism 18 in example modification A.

FIG. 9 is a view showing the configuration of the gusset forming mechanism 18 in this example modification. As shown in FIG. 9, the folding member 18*a* is provided one each on both the right and left side portions of the cylindrical film Fc that is conveyed downward. The gusset forming mechanism 18 can, with the servo motors 18*m*, cause the two folding members 18*a* to independently move in the right and left direction. The two folding members 18*a* are rotatable about the rotating shafts 18*d*. In FIG. 9, the folding member 18*a* on the left side of the cylindrical film Fc rotates in the clockwise direction, and the folding member 18*a* on the right side of the cylindrical film Fc rotates in the counter-clockwise direction. In this example modification also, the gas is blown out from the outer peripheral portions of the two folding members 18*a* by the gas blowing mechanism 19, and sticking between the folding members 18*a* and the cylindrical film Fc is prevented.

In this example modification, the gusset forming mechanism 18 can form the folds G in both the right and left side portions of the cylindrical film Fc. For that reason, the bag making and packaging machine 1 that has the gusset forming mechanism 18 can manufacture bags B having two folds G.

(5-2) Example Modification B

In the embodiment, the gas blowing mechanism 19 is connected to the second disc part 18*c* of the folding member 18*a* via the tube 19*a* and the nozzle 19*b* as shown in FIG. 8. Because of this, the gas that has been blown out from the gas blowing mechanism 19 is supplied to the gas supply space 18*f* between the two disc parts 18*b*, 18*c* of the folding member 18*a* and is blown out from the outer peripheral portion of the folding member 18*a*.

However, the gas blowing mechanism 19 may also blow out the gas at a position away from the folding member 18*a* and blow the gas onto the fold G of the cylindrical film Fc.

Figure 10:
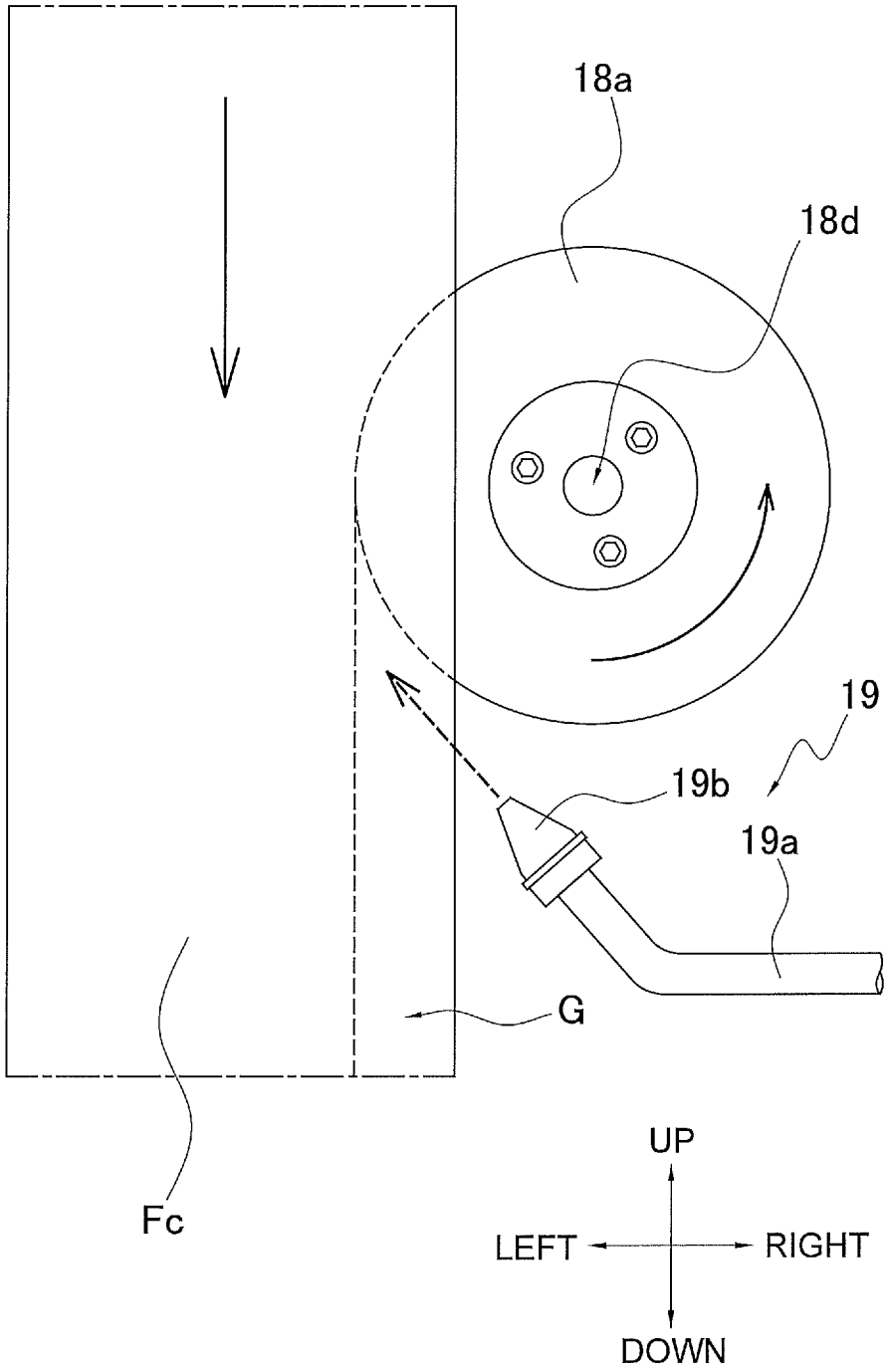
FIG. 10 is a view showing the configuration of a gas blowing mechanism 19 in example modification B.

FIG. 10 is a view showing the configuration of the gas blowing mechanism 19 in this example modification. FIG. 10 is the same view as FIG. 5 and is a front view of the cylindrical film Fc and the folding member 18*a* as seen looking from the front side toward the rear side. The gas blowing mechanism 19 is shown in FIG. 10.

As in the embodiment, the gas blowing mechanism 19 has the tube 19*a* and the nozzle 19*b*. The nozzle 19*b* is attached by a securing member (not shown in the drawings) to a frame or the like of the bag making and packaging unit 3. The gas blowing mechanism 19 is not connected to the folding member 18*a* and blows the gas onto the fold G of the cylindrical film Fc from a position away from the folding member 18*a*. For example, as shown in FIG. 10, the nozzle 19*b* of the gas blowing mechanism 19 is provided under the folding member 18*a* and blows out the gas from the right side toward the left side. In this case, the gas that has been blown out from the nozzle 19*b* is blown onto the fold G just after the fold G has been formed by the folding member 18*a*. In FIG. 10, the flow of the gas that has been blown out from the nozzle 19*b* is indicated by a dashed arrow.

In this example modification, the gas blowing mechanism 19 is a mechanism independent from the folding member 18*a*, so the amount and the direction of the gas that is blown onto the fold G of the cylindrical film Fc can be easily adjusted by adjusting the position and the angle of the nozzle 19*b* of the gas blowing mechanism 19. In FIG. 10, the nozzle 19*b* of the gas blowing mechanism 19 blows the gas from the lower side onto where the cylindrical film Fc and the folding member 18*a* contact each other. However, the nozzle 19*b* of the gas blowing mechanism 19 may also blow the gas from the upper side onto where the cylindrical film Fc and the folding member 18*a* contact each other.

(5-3) Example Modification C

In the embodiment, the gusset forming mechanism 18 has the folding member 18*a* that has the two disc parts 18*b*, 18*c* and the three spacers 18*e*. The two disc parts 18*b*, 18*c* sandwich the three spacers 18*e*, whereby the gas supply space 18*f*, to which the gas is supplied from the gas blowing mechanism 19, is formed between the two disc parts 18*b*, 18*c*.

Figure 11:
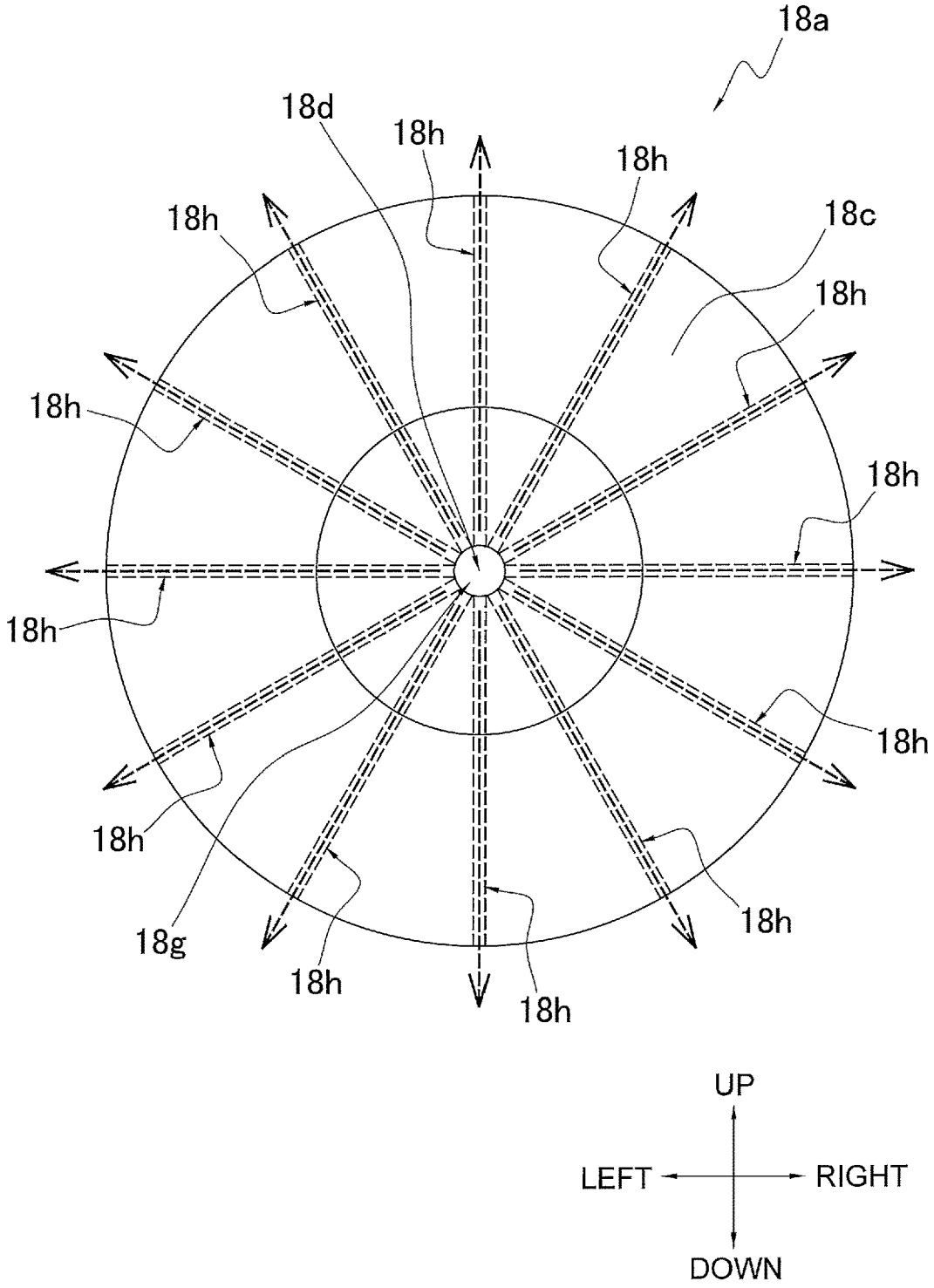
FIG. 11 is a view showing the configuration of the folding member 18*a* in example modification C.

However, it suffices for the gas supply space 18*f* to be an arbitrary space formed between the two circular main surfaces of the folding member 18*a*. That is, the gas supply space 18*f* does not have to be a space between the two disc parts 18*b*, 18*c*. For example, the gas supply space 18*f* may also be a space formed radially inside the folding member 18*a* that is a disc-shaped one-piece body. FIG. 11 is a view showing the configuration of the folding member 18*a* in this example modification. In FIG. 11, the folding member 18*a* has plural gas flow passages 18*h* that extend radially from the center portion of the main surfaces toward the outer peripheral portion. The plural gas flow passages 18*h* are connected to each other at the center portion of the main surfaces and overall form the gas supply space 18*f*. The gas flow passages 18*h* are, for example, holes formed in the radial direction in the folding member 18*a*.

In a case where the nozzle 19*b* of the gas blowing mechanism 19 is connected to the hole (not shown in the drawings) formed in the center portion of the main surfaces of the folding member 18*a* shown in FIG. 11, the gas that has been supplied from the gas blowing mechanism 19 to the gas supply hole 18*g* flows through each of the gas flow passages 18*h* and is blown out from the outer peripheral portion of the folding member 18*a*. For that reason, the folding member 18*a* shown in FIG. 11 can blow the gas onto the fold G of the cylindrical film Fc in the same way as the folding member 18*a* of the embodiment. In FIG. 11, the flows of the gas in each of the gas flow passages 18*h* are indicated by dashed arrows.

In FIG. 11, twelve gas flow passages 18*h* are shown wider than what they actually are in order to make it easier to understand the structure of the folding member 18*a*. However, in order to blow out the gas evenly from the entire outer peripheral portion of the folding member 18*a*, the greater the number of the gas flow passages 18*h* formed inside the folding member 18*a*, the more preferred it is.

REFERENCE SIGNS LIST

1 Bag Making and Packaging Machine
13 Forming Mechanism
14 Pull-down Belt Mechanisms (Conveyance Mechanism)
15 Longitudinal Sealing Mechanism
17 Transverse Sealing Mechanism (Sealing Mechanism)
18 Gusset Forming Mechanism
18*a* Folding Member (Disc-shaped Member)
18*b* Disc Part
18*c* Disc Part
18*f* Gas Supply Space
19 Gas Blowing Mechanism
B Bags
C Contents
F Film (Packaging Material)
Fc Cylindrical Film (Packaging Material Formed in Cylindrical Shape)
G Fold

The invention claimed is:

1. A bag making and packaging machine that fills a packaging material formed into a cylindrical shape with contents and airtightly packages the contents, the bag making and packaging machine comprising:

a conveyance mechanism that conveys the packaging material;

a sealing mechanism that seals the packaging material that is conveyed by the conveyance mechanism;

a rotatable disc-shaped member which, before the sealing mechanism seals the packaging material, pushes against a side portion of the packaging material to thereby fold the packaging material inward and form a fold in the packaging material; and a gas blowing mechanism that blows a gas onto the fold to thereby inhibit the packaging material from sticking to the rotatable disc-shaped member, wherein the gas blowing mechanism blows out the gas from an outer peripheral portion of the rotatable disc-shaped member toward the packaging material and blows the gas onto the fold.

2. The bag making and packaging machine according to claim 1, wherein the gas blowing mechanism supplies the gas to a gas supply space formed between two circular main surfaces of the rotatable disc-shaped member, blows out the gas from the gas supply space toward the packaging material, and blows the gas onto the fold.

3. The bag making and packaging machine according to claim 2, wherein the rotatable disc-shaped member is comprised of two disc parts that oppose each other across a predetermined distance, and the gas blowing mechanism supplies the gas to the gas supply space which is formed between the two disc parts.

* * * * *